United States Patent [19]

Adachi et al.

[11] Patent Number: 4,458,502

[45] Date of Patent: Jul. 10, 1984

[54] AIR CONDITIONING DEVICE

[75] Inventors: Hiroki Adachi; Minoru Shibata; Akio Fukushima; Yasuo Sone; Kiyoshi Sakuma; Takao Komai, all of Shizuoka, Japan

[73] Assignee: Mitsubishi Denki Kabushiki Kaisha, Tokyo, Japan

[21] Appl. No.: 413,542

[22] Filed: Aug. 31, 1982

[30] Foreign Application Priority Data

Oct. 21, 1981 [JP] Japan ..... 56-156569[U]
Oct. 21, 1981 [JP] Japan ..... 56-168154

[51] Int. Cl.[3] ..... F25D 23/12

[52] U.S. Cl. ..... 62/259.1; 62/263; 62/285; 62/DIG. 16; 98/40 D

[58] Field of Search ..... 98/40 D, 31; 62/263, 62/285, DIG. 16, 259.1, 449, 239; 165/48

[56] References Cited

U.S. PATENT DOCUMENTS 2,212,748 8/1940 Parker ..... 62/DIG. 16
2,813,406 11/1957 Smith ..... 62/259.1 X
2,963,882 12/1960 Malkoff et al. .

FOREIGN PATENT DOCUMENTS 1270260 6/1968 Fed. Rep. of Germany .... 62/DIG. 16
55-35872 3/1980 Japan ..... 62/DIG. 16

*Primary Examiner*—Lloyd L. King

*Attorney, Agent, or Firm*—Oblon, Fisher, Spivak, McClelland & Maier

[57] ABSTRACT

An air conditioning device for cooling and/or warming a room by introducing thereinto air in the room and heat exchanging the same. The device comprises an outer housing having a top covering wall 1*a* to face the ceiling, a rear covering wall 1*b* to face the rear wall surface, and side covering walls 2 to skirt left and right sides of the device. Partition member 3 divides said outer housing interior into an air intake chamber 4 and an air blowing chamber 5, said partition member having mechanical strength, and constituting a skeleton together with said outer walls, 1*a,* 1*b,* and 2, 2. A side covering panel 21 is fitted on said side covering walls to cover either or both said side covering walls 2. An air blowing means is provided in said air intake chamber 4 for sending air into said air blowing chamber 5. An air filter 7 is provided in said air intake chamber to remove dust in the air to be taken in by said air blowing means. An air intake grill 6 is provided on the lower surface of said outer housing between said rear covering wall 1*b* and said partition member 3, said grill being disposed in a freely mountable and dismountable manner. A forward air blowing grill 20 is provided in front of said outer housing. A heat exchanger is provided in said air blowing chamber. A downward air blowing grill is provided on the lower surface of said outer housing between said forward air blowing grill 20 and said heat exchanger 10.

25 Claims, 9 Drawing Figures

AIR CONDITIONING DEVICE

BACKGROUND OF THE INVENTION

1. Field of the Invention

This invention relates to an overall construction of an air conditioning device. More particularly, it is concerned with a construction of the air conditioning device to be hangingly fitted, for use, on the surface of the ceiling of a room or a compartment.

2. Description of the Prior Art:

In a heretofore known type of the air conditioner which can be hung from the surface of the ceiling in a room, and be snugly fitted onto the surface of the ceiling and the room rear wall surface, various electrical parts and components are mounted on the lateral side of the air conditioner with the consequence that a space of a size of 50 cm or so should be provided at the lateral side of the air conditioner to facilitate various services such as, for example, connection of electrical wires at the time of mounting or maintenance of the electrical parts. The reason for this is that, even in the air conditioning device of a type to be mounted on the surface of the ceiling, effective use of the space for service can be difficult to realize depending on the place where it is fitted (such as, for example, shops and stores where show cases of considerable height are arranged near the air conditioning device), and that provision of such service space at the lateral side of the air conditioning device spoils the design of the room interior, and various other inconveniences.

Further, when the air is to be blown downwardly from the air conditioning device, it has so far been a practice to provide a vane in the blowing direction just in front of an air blowing grill. In this case, however, the downward blowing of the air is inevitably restricted due to a limited turning angle of the vane with the consequence that air cannot be blown down to a space immediately below the air conditioner, as a matter of course, and other disadvantages.

SUMMARY OF THE INVENTION

It is therefore the primary object of the present invention to provide an air conditioning device capable of removing the above-mentioned defects in the conventional air conditioning device.

It is another object of the present invention to provide an air conditioning device of a type to be hung from the ceiling, in which two air blowing grills are provided, one for blowing air, either cold or warm, in the frontward direction, and the other for blowing air directly downward of the air conditioning device, thereby improving the distribution of air currents within the room or compartment.

It is still another object of the present invention to provide an air conditioning device capable of being fitted snugly in contiguity to the surface of the ceiling and the rear wall of the room.

It is another object of the present invention to provide an air conditioning device which can be subjected, in its mounted condition, to maintenance and repair works by simply removing an air intake grill underneath the air conditioning device, so that repair, replacement, etc. of electrical parts and/or connecting terminals, and so on may be done from below the device.

It is still another object of the present invention to provide an air conditioning device of a construction, in which a skeleton is constructed with a top covering plate to face the ceiling and a rear covering plate to face the rear wall, both of which are integrally formed, flat side covering plates, as separate members, to skirt both left and right sides of the device, and a rigid partition plate to separate an air intake chamber and an air blowing chamber. An air filter for an air intake grill is provided, in a freely mountable and dismountable manner, on the lower surface of the device between the rear covering plate and the partition plate. A lower panel is disposed at the lower surface of the device between the partition plate and the front end. An upper panel continuous with the top covering plate extends to the front end of the device. An air blowing grill is provided in a space defined between the upper and lower panels. Finally, an ornamental side covering panel is disposed around the outer surface of the above-mentioned side covering plate.

It is a further object of the present invention to provide an air conditioning device of the above-mentioned general construction, in which an air blowing device is rigidly fixed on the air intake side of the partition plate, and further electrical component parts for the air conditioner are accommodated in one part of the air intake chamber, i.e., the space to be defined by the rear covering plate, a part of the top covering plate, the partition plate, and the air intake grill, where the air blowing device is also accommodated, in a manner to be adapted for manipulations of the air conditioning device, repair and maintenance thereof such as wiring connections and various other services, to be done from the lower surface of the device.

According to the present invention, in its general aspect, there is provided an air conditioning device for cooling and/or warming a room by introducing thereinto air in the room and heat-exchanging the same, which comprises an outer housing having a top covering wall facing the ceiling, a rear covering wall facing the rear wall surface, and side covering walls skirting the left and right sides of the device. A partition member divides the outer housing interior into an air intake chamber and an air blowing chamber, the partition member having mechanical strength and constituting a skeleton together with said outer walls. A side covering panel is fitted on the side covering walls to cover either or both of said walls. An air blower is provided in the air intake chamber for sending air into the air blowing chamber. An air filter is provided in the air intake chamber to remove dust in the air to be taken in by the air blower. An air intake grill is provided on the lower surface of said outer housing between the rear covering wall and the partition member, said grill being disposed in a freely mountable and dismountable manner. A forward air blowing grill is provided in front of the outer housing. A heat exchanger is provided in the air blowing chamber. A downward air blowing grill is provided on the lower surface of the outer housing between the forward air blowing grill and the heat exchanger. Finally, an electrical parts box, to receive therein electrical parts and a plurality of electrical connecting terminals, is provided in the vicinity of the air intake grill of the air intake chamber and at a position where the connecting terminals and/or electrical parts can be subjected to repair and maintenance with the air intake grill being removed.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
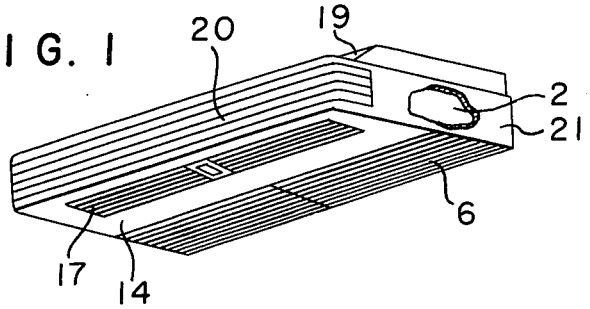
FIG. 1 is a perspective view, with one portion being cut away, of an air conditioning device according to the present invention.
Figure 2:
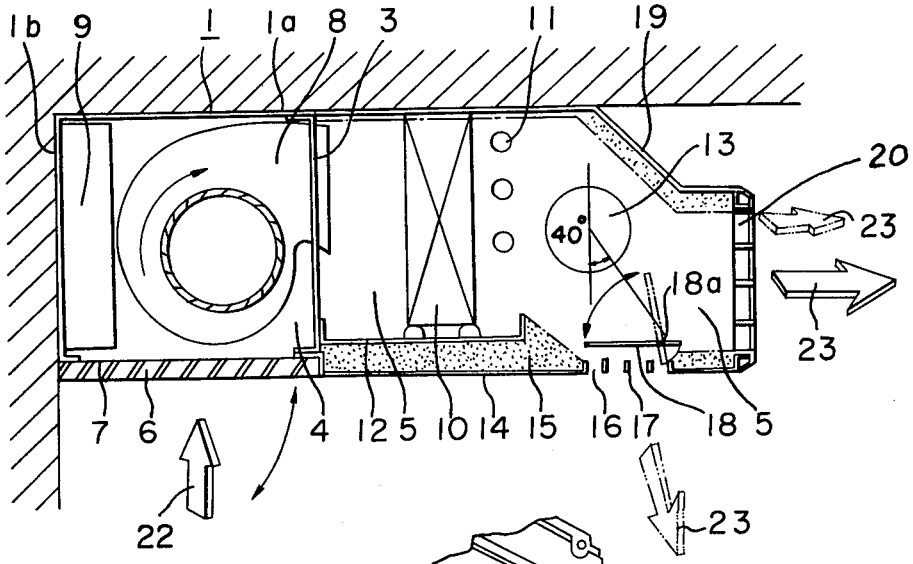
FIG. 2 is a cross-sectional view of the air conditioning device according to the present invention.
Figure 3:
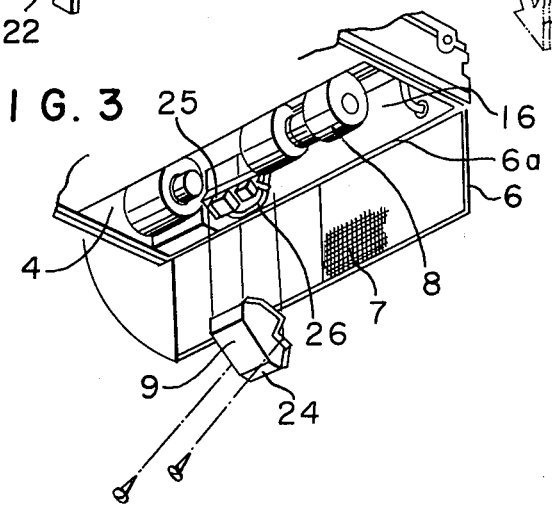
FIG. 3 is an explanatory perspective view of a part of the air conditioning device according to the present invention, in a state of its being mounted in contiguity to the ceiling surface and the rear wall surface, wherein the electrical parts and/or connecting terminals accommodated in the device are subjected to adjustment or maintenance or repair services from an opening formed by removal of the air intake grill.
Figure 4:
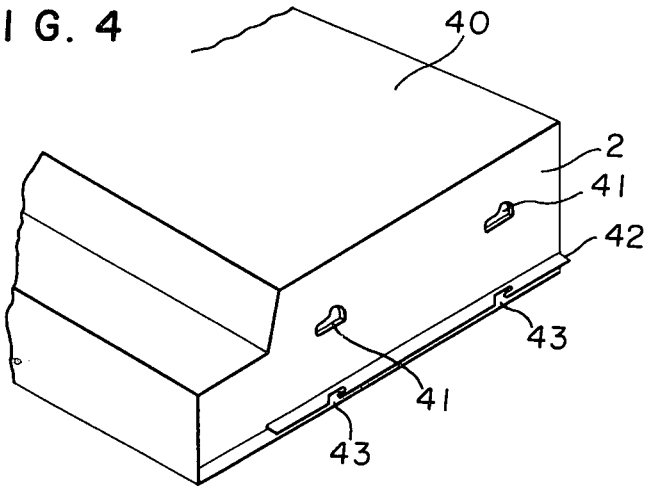
FIG. 4 is an enlarged perspective view of a main part of another embodiment of the air conditioning device according to the present invention, wherein the ornamental side covering panel in FIG. 1 has been removed.
Figure 5:
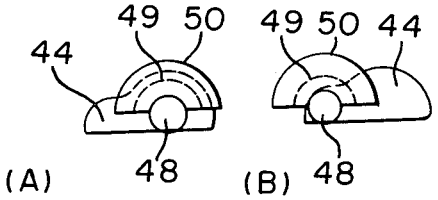
FIG. 5A illustrates a state wherein a projecting pin of the side covering panel is set in an engagement hole.
FIG. 5B illustrates a state wherein the projecting pin has become locked with the engagement hole.
Figure 6:
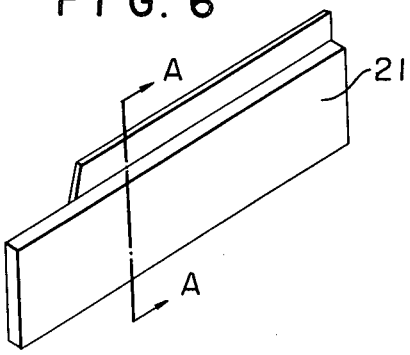
FIG. 6 is a perspective view of the side panel.
Figure 7:
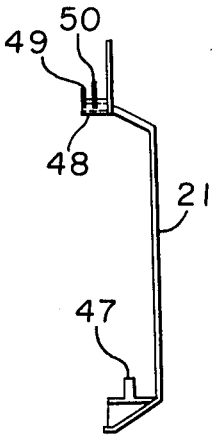
FIG. 7 is a cross-sectional view of the side panel shown in FIG. 6 taken along the line A—A therein.

In the following, the present invention will be described in detail with reference to one preferred embodiment thereof as shown in FIGS. 1 to 3.

In FIGS. 1 to 3, a reference numeral 1 designates an L-shaped outer wall of the air conditioning device of the present invention, which is formed by bending a single sheet of metal material at substantially a right angle to constitute the top covering wall 1*a* to face the ceiling and the rear covering wall 1*b* to face the rear wall surface. A numeral 2 refers to the side covering walls to skirt both left and right sides of the device, the side covering walls being made of a planar sheet material and fixedly secured to the L-shaped outer wall 1. A numeral 3 refers to the partition plate made of a rigid material having an angled U-shape in its cross section. The partition plate is fixedly secured in a space defined by the L-shaped outer wall 1 and the side covering walls 2 and defines the air intake chamber 4 and the air blowing chamber 5 in the space. Thus, the outer casing for the air conditioning device according to the preferred embodiment of the present invention constitutes a rigid skeleton with each of the above-described outer walls 1*a*, 1*b*, 2 and the partition plate 3 rigidly joined together.

A numeral 6 refers to the air intake grill which is made of a resin material, etc., and is mounted in a freely mountable and dismountable manner on the lower side of the outer casing. The lower end part of the rear covering wall 1*b* is a pivotal axis 6*a* for the oscillatory movement of one edge portion of the grill 6, and the lower end of the partition plate 3 is a stopper for the other edge portion of the grill 6. A reference numeral 7 designates an air filter to be equipped on the air intake grill 6 in a freely mountable and dismountable manner. A reference numeral 8 denotes an air blowing device, or a blower, composed of a plurality of electric motors for the blower, line flow fans and fan casings, all of which are rigidly fixed to the partition plate 3.

A numeral 9 refers to a box for accommodating therein electrical parts, which comprises a main body part 25 and a lid 24, in which various electrical parts and a power source terminal board, etc. are accommodated, the power source terminal board being fitted in such a manner that its connecting parts face downward so as to enable the electric wire 26 to be connected from the lower surface. Further, the electrical parts box 9 is positioned in one part of the air intake chamber, i.e., the space formed by the top covering wall 1*a*, the rear covering wall 1*b*, the partition wall 3, and the air intake grill 6 where the air blowing device 8 is also accommodated. The electrical parts box is fitted on the above-mentioned rear covering wall 1*b* in a manner to be freely mountable thereon and dismountable therefrom, and to be removable from the main body part through the lower surface of the outer casing.

Figure 8:
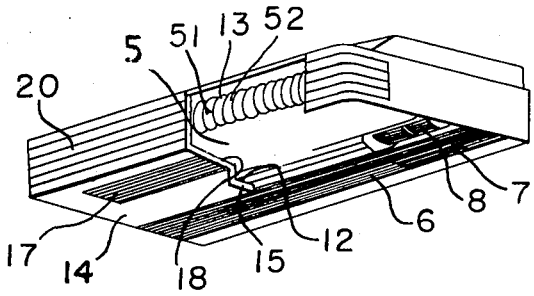
FIG. 8 is a perspective view, with one portion being cut away, of an air conditioning device, for the purpose of illustrating a louver.
Figure 9:
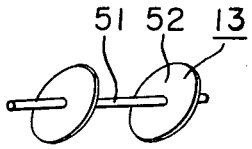
FIG. 9 is an enlarged persepective view of a part of louver shown in the FIG. 8.

A numeral 10 refers to a heat-exchanger which is disposed uprightly at a position in the air blowing chamber 5 in front of the partition plate 3. The heat exchanger 10 has gas side tubing and liquid side tubing, the distal end of each tubing being provided with a connecting joint which is fixed at a portion continuous to the partition plate 3 for communication with sources of heat exchange fluids (not shown). A numeral 11 refers to an electric heater which is disposed in front of the heat exchanger 10 in parallel with the same. A reference numeral 12 designates a receptacle for condensation, which is disposed below the heat exchanger 10, the electric heater 11, etc. to receive therein the condensation developed and adhered on the surface of these components. A numeral 13 refers to a louver for changing the air blowing direction, said louver being positioned in front of the electric heater 11 to disperse the air blown out of the blower 8 and past the heat exchanger 10. As shown in FIGS. 8 and 9, the louver 13 for changing the air blowing direction comprises a large number of elliptic blades 52 fixed to a rotary shaft 51 with a predetermined angle (The shape of the blades, therefore, looks circular in the end view). Revolution of the rotary shaft 51 automatically changes the direction of the air flow passed through the heat exchanger 10 by the blower 8 all around.

A reference numeral 14 indicates a lower panel of a box shape, the four sides of which have outwardly bent, crank-shaped flanges. The back end of the lower panel 14 is fixed to the lower end of the partition plate 3 by means of threaded screws, etc., and its lateral sides are fixed to the side covering wall 2. A reference numeral 15 designates a heat insulating material. A numeral 16 indicates a downward air blowing aperture of the lower panel 14 at an angle of approximately 40 degrees frontward from a point immediately below the air blowing direction changing louver 13 with the same as the center of oscillation. A reference numeral 17 denotes a downward air blowing grill formed of a resin material and fixed in the downward blowing aperture 16. A numeral 18 refers to a variable vane for the downward air blowing direction, which is positioned at the downward blowing grill 17 on the side of the blowing direction changing louver 13, the position being spaced somewhat from the downward blowing grill 17 at a predetermined distance. The variable vane, or shutter, 18 is so hinged at its forward edge that its rear edge may be raised upward with the hinged forward end as a pivotal axis 18*a*, the degree of its opening being made variable by combination of a rack and a pinion. A numeral 19 refers to an upper panel which continues forwardly from the top covering wall 1*a*, and is fixedly secured to the top covering wall 1*a* and the side covering walls 2. A reference numeral 20 represents a forward air blowing grill which can be readily formed in a space defined by the lower panel 14 and the upper panel 19. A reference numeral 21 designates a side covering panel which can be readily fitted on the side covering wall 2. This is an ornamental outer panel which gives a sightly appearance to the air conditioning device along with the above-mentioned air intake grill 6, the lower panel 14, the downward air blowing grill 17, the upper panel 19, and the forward air blowing grill 20.

In the following, explanations will be given as to the function of the air conditioning device of the aforedescribed construction. By the operation of the air blower 8, air 22 introduced into the chamber 4 through the air intake grill 6 and the air filter 7 is sent into the chamber 5, and treated by the heat exchanger 10 therein to cool the air (at the time of cooling the room) or to warm it (at the time of warming the room). The conditioned air is dispersed by the air blowing direction changing louver 13 to be blown outside through the air blowing grill 20 or 17, or both, as the blown air 23. At this instant, if the variable vane 18 for the downward blowing direction is in parallel with the downward blowing grill 17, i.e., a state of closure of the grill 17 (in particular, at the time of cooling), a large amount of air 23 is blown out through the forward blowing grill 20, whereas, when the variable vane 18 for the downward blowing direction is fixed at a desired angle with respect to the downward blowing grill 17, i.e., a state of opening of the grill 17 (in particular, at the time of warming), the air 23 is divided by the vane 18, erected at a desired angle, into both the frontward and downward direction, and is dispersed by the blowing direction changing louver 13, and blown outside. Also, by the opening of this variable vane 18 for the downward blowing direction, there can be realized optimum air conditioning to the area directly below the main body of the air conditioning device, which has so far been considered a dead space where no positive air conditioning is possible.

Further, as has already been described in detail in the foregoing for the overall construction of the air conditioning device, the connecting work of the electric wire 26 can be done from beneath the device main body; that is, when the air intake grill 6 is first opened, the air blower 8 and the electrical parts box 9 can be viewed with the eyes. Further, when the threaded screws which fasten the lid of the electrical parts box 9 are removed, there is the power source terminal board installed in the box 9, to which the electric wire can be readily connected from below. The electrical parts box 9 is fixedly secured to the inner surface of the rear covering wall 1*b*. When the screws fastening the box to the wall 1*b* are removed, the box 9 can be taken outside through the lower opening of the housing, whereby the maintenance and repair services of the electrical parts can be done at the lower part of the housing.

Since the air conditioning device according to the present invention is constructed as has been described in the foregoing, there is no necessity for providing a service space at the lateral side of the air conditioning device, whereby there can be provided the air conditioning device which realizes effective use of the ceiling surface, and, moreover, which is suited for the room interior. Furthermore, as to the air blowing direction immediately below the air conditioning device, the air 23 which has been dispersed by the blowing direction changing louver 13 can be blown out of the downward blowing grill 17, thereby providing a uniform and comfortably air-conditioned room, etc.

In the following, explanations will be given as to another embodiment of the air conditioning device according to the present invention in reference to FIGS. 4 to 7.

In the drawings, a reference numeral 40 designates the main body of the air conditioning device, a numeral 2 refers to the side covering wall of this main body 40. Notched recesses 43 are formed in an L-shaped flange 42 at the lower end part of the side covering wall 2, and engagement holes 41 are formed in the middle portion of the side covering wall. The engagement hole 41 is in the form of a small diameter semicircle and a large diameter semicircle being joined together overlappingly. The side covering panel 21 surrounding this side covering wall portion is usually made of a shaped plastic material, etc., which is so formed that a projecting pin A 47 is uprightly provided at its lower end part, and a projecting pin B 48 is transversely provided at the middle portion of the panel, the pin B having a distal end piece 49 which is smaller than the large diameter semicircular portion of the engagement hole 41 and larger than the smaller diameter semicircular portion thereof and a second piece 50 behind the distal end piece 49 which is larger than the large diameter portion of the engagement hole 41.

With this construction, when the distal end piece 49 is inserted into the engagement hole 41, the second piece 50 serves as a stopper. With such construction, since the side covering panel 21 can be slide-engaged with the side covering wall 2 utilizing the L-shaped flange 42 on the side covering wall 2 of the main body 40, there is no hindrance caused thereto. It is also not necessary to shape the L-shaped flanged piece into an angled U-shape by attaching a separate member. Further, since the lower part of the engagement hole 41 is rectilinear, the projecting pin B 48 which contacts the small diameter part of the engagement hole when the side covering panel 21 is fitted on the side wall 2 is not able to go down further by its own dead weight. Moreover, in order that the projecting pin B 48 may be inserted into, and slide-engaged with, the engagement hole 41 along its rectilinear lower portion, the distal end piece 49 and the second piece 50 of the projecting pin B can be in the semicircular form, and the side covering panel 21 is shaped in a concave form with a plastic material. Accordingly, this embodiment of the present invention has an advantage such that the shaped panel securement elements 41 and 44 can be provided in one side surface side alone.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An air conditioning device for treating the air in a room, comprising:

an outer housing having a top covering wall adapted to face the ceiling of said room, a rear covering wall adapted to face the rear wall surface of said room, and side covering walls to enclose left and right sides of said device;

a partition member in said outer housing to divide said outer housing into an air intake chamber and an air blowing chamber, said partition member constructed to have mechanical strength, and together with said outer housing, constituting a skeleton;

a side covering panel fitted on said side covering walls to cover at least one of said side covering walls;

air blowing means provided in said air intake chamber for sending air into said air blowing chamber;

an air filter provided in said air intake chamber to remove dust in the air to be taken in by said air blowing means;

an air intake grill provided on the lower surface of said outer housing between said rear covering wall and said partition member, said grill being disposed in a freely mountable and dismountable manner;

a forward air blowing grill provided on a wall of said outer housing opposite said rear covering wall;

a heat exchanger provided in said air blowing chamber;

a downward air blowing grill provided on said lower surface of said outer housing between said forward air blowing grill and said heat exchanger; and an electrical parts box adapted to receive therein electrical parts and a plurality of electrical connecting terminals, said box being provided adjacent said air intake grill and in said air intake chamber at a position where said connecting terminals and electrical parts can be subjected to repair and maintenance when said air intake grill is removed.

2. The air conditioning device as set forth in claim 1, wherein said side covering panel is constructed as an ornamental plastic panel, and is fitted on said side covering walls, in a freely mountable and dismountable manner.

3. The air conditioning device as set forth in claim 1, wherein said air blowing means comprises a fan casing and a line flow fan.

4. The air conditioning device as set forth in claim 3, wherein said electrical parts box is provided between said rear covering wall and said fan casing, said rear covering wall having no opening for maintenance work.

5. The air conditioning device as set forth in claim 1, wherein said electrical parts box is freely removable through the opening of said air intake grill.

6. The air conditioning device as set forth in claim 1, wherein said air filter and said air intake grill are integrally combined in a closely adjacent relationship with each other, said air filter being removable in a state of said air intake grill having been removed.

7. The air conditioning device as set forth in claim 1, wherein the electric heater is provided in said air blowing chamber in the vicinity of said heat exchanger.

8. The air conditioning device as set forth in claim 7, further comprising a receptacle for receiving condensation developed and adhered on said heat exchanger and said electric heater.

9. The air conditioning device as set forth in claim 7, wherein said electric heater is provided between said heat exchanger and said air blowing grill.

10. The air conditioning device as set forth in claim 1, wherein an air blowing direction changing louver to disperse the air blowing direction is provided in said air blowing chamber in the vicinity of said air blowing grill.

11. The air conditioning device as set forth in claim 1, wherein said air conditioning device is mounted in such a manner that said top covering wall and rear covering wall thereof are contiguous to said ceiling surface and rear wall surface of the room.

12. The air conditioning device as set forth in claim 1, wherein concave portions and convex portions are formed in said side covering walls and said side covering panel, respectively, said concave and convex portions being mutually slide-engaged to hold said side covering wall and side covering panel in position.

13. The air conditioning device as set forth in claim 12, wherein said engaging concave portion is an engagement hole formed by notching a portion of said side covering wall in the form of a small diameter semicircle and a large diameter semicircle, both being joined overlappingly, and said engaging convex portion is constructed inside said side covering panel, with a projecting pin having a pair of semicircular flanges, a distal end flange portion thereof having a diameter which is smaller than the large diameter portion of said engagement hole and larger than the small diameter portion thereof, and a second flange portion being larger than the large diameter portion of said engagement hole.

14. The air conditioning device as set forth in claim 12, wherein said engaging concave portion is a notched concave portion formed in an L-shaped bent piece provided on the side covering wall, and said engaging convex portion is a projecting pin provided inside said hole covering panel, and inserted into said concave portion at a right angle.

15. An air conditioning device to be mounted in contiguity to the ceiling surface in a room, for treating the room by introducing thereinto air in the room and heat exchanging said air, which comprises:

an outer housing having a top covering wall adapted to face the ceiling of said room, a rear covering wall adapted to face the rear wall surface of said room, and side covering walls to enclose left and right sides of said device;

a partition member in said outer housing to divide said outer housing into an air intake chamber and an air blowing chamber, said partition member constructed to have mechanical strength, and together with said outer housing, constituting a skeleton;

a side covering panel fitted on said side covering walls to cover at least one said side covering walls;

air blowing means provided in said air intake chamber for sending air into said air blowing chamber;

an air intake grill provided on the lower surface of said outer housing between said rear covering wall and said partition member, said grill being disposed in a freely mountable and dismountable manner;

an air filter provided in said air intake chamber to remove dust in the air to be taken in by said air blowing means, said air filter being mounted on said air intake grill in a freely mountable and dismountable manner;

a forward air blowing grill provided on a wall of said outer housing opposite said rear covering wall and in a freely mountable and dismountable manner;

a heat-exchanger and an electric heater provided in said air blowing chamber;

a downward air blowing grill provided on said lower surface of said outer housing between said forward air blowing grill and said heat-exchanger; and an electrical parts box adapted to receive therein electrical parts and a plurality of electrical connecting terminals, said box being provided adjacent said air intake grill and in said air intake chamber at a position where said connecting terminals and electrical parts can be subjected to repair and maintenance when said air intake grill is removed, said electrical parts box being further freely removable through an opening of said air intake grill.

16. The air conditioning device as set forth in claim 15, wherein said air blowing means comprises a fan casing and a line flow fan.

17. The air conditioning device as set forth in claim 16, wherein said electrical parts box is provided between said rear covering wall and said fan casing, said rear covering wall having no opening for maintenance service.

18. The air conditioning device as set forth in claim 15, wherein an air blowing direction changing louver to disperse the air blowing direction is provided in said air blowing chamber in the vicinity of said air blowing grill.

19. The air conditioning device as set forth in claim 18, further comprising a shutter to close the opening of said downward air blowing grill, provided in said air blowing chamber.

20. The air conditioning device as set forth in claim 19, wherein said shutter is so constructed that it can open at the time of warming the room.

21. The air conditioning device as set forth in claim 16, wherein said shutter is constructed with a downward blowing direction variable vane which is pivotally opened and closed with an edge facing said forward air blowing grill as the pivotal axis.

22. The air conditioning device as set forth in claim 18, wherein said downward air blowing direction variable vane corresponds in size to said downward blowing grill and is provided in a space defined by an angular range of 40 degrees forward from a point immediately below said blowing direction changing louver, wherein said vane opens and closes said downward blowing grill.

23. The air conditioning device as set forth in claim 15, further including a condensation receiving tray provided below said heat exchanger and electric heater to receive therein condensation developed and adhered on the surfaces of the components.

24. The air conditioning device as set forth in claim 23, wherein a heat insulating material is provided beneath said condensation receiving tray.

25. An air conditioning device to be mounted in contiguity to the ceiling surface in a room, and for treating the room by introducing therein air in the room and heat exchanging said air, which comprises:

an outer housing having a top covering wall adapted to face the ceiling of said room, a rear covering wall adapted to face the rear wall surface of said room, and side covering walls to enclose left and right sides of said device;

a partition member in said outer housing to divide said outer housing into an air intake chamber and an air blowing chamber, said partition member being constructed to have mechanical strength, and together with said outer housing, constituting a skeleton;

a side covering panel to be fitted on said side covering walls to cover at least one of said side covering walls;

a fan casing provided in said air intake chamber for sending air into said air blowing chamber, and a fan provided in said fan casing;

an air intake grill provided on the lower surface of said outer housing between said rear covering wall and said partition member, said grill being disposed in a freely mountable and dismountable manner;

an air filter provided in said air intake chamber to remove dust in the air to be taken in by said blowing means, said air filter being mounted on said air intake grill in a freely mountable and dismountable manner;

a forward air blowing grill provided in a wall of said outer housing opposite said rear covering wall in a freely mountable and dismountable manner;

a heat exchanger and an electric heater provided in said air blowing chamber;

a downward air blowing grill provided on the lower surface of said outer housing between said forward air blowing grill and said heat exchanger;

an electrical parts box adapted to receive therein electrical parts and a plurality of electrical connecting terminals, said box being provided adjacent said air intake grill between said rear covering wall and said fan casing, and at a position where said connecting terminals and electrical parts can be subjected to repair and maintenance when said air intake grill is removed, said electrical parts box being further removable freely through an opening of said air intake grill;

an air blowing direction changing louver provided in said air blowing chamber for dispersing the blowing air;

a shutter adapted to open and close an opening in said downward blowing grill; and a receiving tray for receiving therein condensation developed and adhered on the surfaces of said heat exchanger and electric heater, said tray being placed below said heat exchanger and heater.

* * * * *